US006378497B1

(12) United States Patent
Keyster et al.

(10) Patent No.: US 6,378,497 B1
(45) Date of Patent: Apr. 30, 2002

(54) ACTUATION FLUID ADAPTER FOR HYDRAULICALLY-ACTUATED ELECTRONICALLY-CONTROLLED FUEL INJECTOR AND ENGINE USING SAME

(75) Inventors: Eric S. Keyster; Jack A. Merchant, both of Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/442,948

(22) Filed: Nov. 18, 1999

(51) Int. Cl.[7] ..... F02M 37/04
(52) U.S. Cl. ..... 123/446; 123/470
(58) Field of Search ..... 123/446, 509, 123/468, 469, 447, 470; 239/88–96

(56) References Cited

U.S. PATENT DOCUMENTS

| | | | | | |
|---|---|---|---|---|---|
| 2,914,053 | A | | 11/1959 | Hitell | |
| 4,385,609 | A | | 5/1983 | Kato | |
| 4,628,881 | A | * | 12/1986 | Beck et al. | 123/447 |
| 5,062,405 | A | | 11/1991 | Daley | |
| 5,271,371 | A | | 12/1993 | Meints et al. | |
| 5,297,523 | A | * | 3/1994 | Hafner et al. | 123/456 |
| 5,325,834 | A | * | 7/1994 | Ballheimer et al. | 123/446 |
| 5,398,658 | A | | 3/1995 | Mesimäki | |
| 5,471,959 | A | | 12/1995 | Sturman | |
| 5,669,355 | A | * | 9/1997 | Gibson et al. | 123/446 |
| 5,682,858 | A | | 11/1997 | Chen et al. | |
| 5,806,494 | A | | 9/1998 | Grassey | |
| 5,878,720 | A | * | 3/1999 | Anderson et al. | 123/496 |
| 6,026,785 | A | * | 2/2000 | Zuo | 123/446 |

* cited by examiner

*Primary Examiner*—Carl S. Miller
(74) *Attorney, Agent, or Firm*—Liell & McNeil

(57) ABSTRACT

A fuel injector adapter consists of a block defining a pressure communication passage therethrough and an actuation fluid passage. The actuation fluid passage includes three separate branches that open through an outer surface of the block at three separate locations.

15 Claims, 3 Drawing Sheets

ACTUATION FLUID ADAPTER FOR HYDRAULICALLY-ACTUATED ELECTRONICALLY-CONTROLLED FUEL INJECTOR AND ENGINE USING SAME

GOVERNMENT LICENSE RIGHTS

The U.S. Government has a paid-up license in this invention and the right in limited circumstances to require the patent owner to license others on reasonable terms as provided for by the terms of DE-AC05-970R22605, awarded by the Department of Energy. In other words, this invention was made with Government support under DE-AC05-970R22605 awarded by the Department of Energy. The Government has certain rights in this invention.

TECHNICAL FIELD

The present invention relates generally to hydraulically-actuated, electronically-controlled fuel injectors, and more particularly to an adapter for hydraulically-actuated, electronically-controlled fuel injectors that better facilitates usage of the same in a broader range of engine designs.

BACKGROUND ART

Several advances in fuel injector technology have been made in recent years. For instance, Caterpillar, Inc. of Peoria, Ill. has found particular success with hydraulically-actuated electronically-controlled fuel injectors. These fuel injectors have performed very well in engines designed by Caterpillar, Inc., and other engine manufacturers have begun to recognize the advantages of these systems. However, incorporation of HEUI systems is not easily accomplished without substantial and undesirable design changes to the engine, particularly the head. In particular, the actuation fluid inlet of many hydraulically-actuated electronically-controlled fuel injectors is located within the engine head when installed. Without alteration to the fuel injectors, a costly redesign of the engine head to include an internal oil rail would be needed to allow these fuel injectors to be used in many current engines.

The present invention is directed to overcoming one or more of the problems set forth above and to better facilitating the usage of hydraulically-actuated electronically-controlled fuel injectors in a broader range of engines.

DISCLOSURE OF THE INVENTION

A fuel injector adapter consists of a block defining a pressure communication passage therethrough and an actuation fluid passage. The actuation fluid passage includes three separate branches that open through an outer surface of the block at three separate locations.

BEST MODE OF CARRYING OUT THE INVENTION

Figure 1:
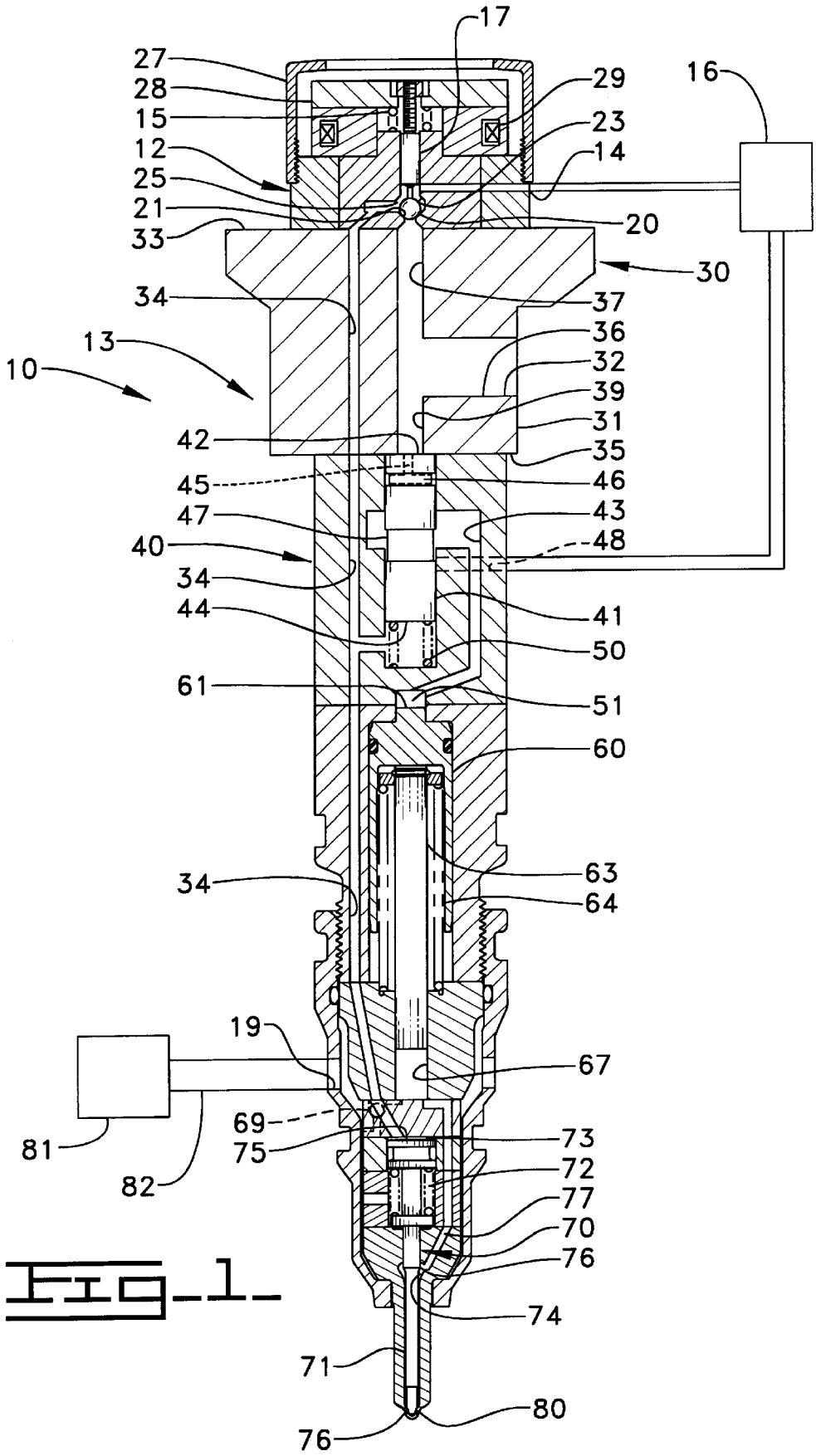
FIG. 1 is a diagrammatic sectioned side view of a hydraulically-actuated electronically-controlled fuel injector according to the present invention.

Referring now to FIG. 1 there is shown a diagrammatic sectioned side view of a hydraulically-actuated electronically-controlled fuel injector 10 according to the present invention. Fuel injector 10 includes an injector body 11 made up of various components that are attached to one another in a manner well known in the art and a substantial number of internal movable components positioned as they would be just prior to an injection event. Among the various components, fuel injector 10 includes a fuel injector valve assembly 13 made up of a pilot valve subassembly 12, a flow control valve subassembly 40, and an actuation fluid adapter 30. Actuation fluid, which is preferably high pressure oil, enters injector body 11 through an actuation fluid inlet 32 which is defined by actuation fluid adapter 30. Actuation fluid exits injector body 11 through an actuation fluid vent 14 and a low pressure drain 48 that are preferably defined by injector body 11. Injector body 11 also defines a fuel inlet 19 through which fuel can enter fuel injector 10. While the present invention preferably utilizes engine lubricating oil as the actuation fluid, it should be appreciated that other liquids could instead be used. In addition, while distillate diesel fuel is preferable, other fuels could instead be used.

Fuel injector 10 is controlled in its operation by pilot valve subassembly 12. A pilot valve member, preferably ball valve member 20, is included in pilot valve subassembly 12 and is trapped in a control volume 25 between a high pressure seat 21 and a low pressure seat 23. Pilot valve subassembly 12 also includes an electrical actuator 27 that is preferably a solenoid but could be any suitable device such as a piezoelectric actuator. Electrical actuator 27 includes a coil 29 and an armature 28 that is attached to a pin 17. When electrical actuator 27 is de-energized, such as prior to an injection event, ball valve member 20 is hydraulically biased by the constant high pressure in inlet 32 to close low pressure seat 23. When low pressure seat 23 is closed, control volume 25 is fluidly connected to high pressure actuation fluid entering fuel injector 10 through inlet 32. When electrical actuator 27 is energized, pin 17 is moved downward by armature 28 against the action of a biasing spring 15 to push ball valve member 20 to close high pressure seat 21 and open low pressure seat 23. When ball valve member 20 is in this position, control volume 25 is fluidly connected to low pressure in low pressure actuation fluid vent 14. Pilot valve subassembly 12 is abutted against a planar surface 33 of actuation fluid adapter 30, which can also be utilized as a clamping surface when mounting injector 10 in an engine.

Actuation fluid adapter 30 is preferably machined from a single metallic block to define a number of passages, some of which are in fluid communication with control volume 25. These passages include a pressure communication passage 34 and an actuation fluid passage that has three separate branches. These three branches open to separate locations on an outer surface 31 of actuation fluid adapter 30 and include actuation inlet passage 36, an actuation control passage 37 and an actuation supply passage 39. High pressure oil entering actuation fluid adapter 30 through actuation fluid inlet 32 flows through actuation inlet passage 36 and into actuation control passage 37 or actuation supply passage 39. Actuation inlet passage 36 opens through outer surface 31 at actuation fluid inlet 32 and is preferably oriented perpendicular to both actuation control passage 37 and actuation supply passage 39 in this embodiment. As illustrated in FIG. 1, actuation control passage 37 opens through planar surface 33 and is covered by pilot valve subassembly 12 while actuation supply passage 39 opens through a planar surface 35 that is substantially parallel to planar surface 33. When electrical actuator 27 is de-energized, high pressure in actuation control passage 37 produces the force that biases ball valve member 20 to close low pressure seat 23. A pressure communication passage 34 passes through actuation fluid adapter 30 and opens on its opposite ends through planar surface 33 and planar surface 35. Pressure communication passage 34 fluidly connects control volume 25 to various passages in flow control valve subassembly 40 and fuel injector 10, as discussed below.

Actuation fluid adapter 30 is attached to flow control valve subassembly 40 such that flow control valve subassembly 40 is in contact with planar surface 35 and covers both actuation supply passage 39 and pressure communication passage 34 where they open through outer surface 31. This fluid communication between flow control valve subassembly 40 and pilot valve subassembly 12 through pressure communication passage 34 allows flow control valve subassembly 40 to be operably coupled to electrical actuator 27. Flow control valve subassembly 40 includes a spool valve member 41 that is movable between a first position in contact with adapter 30 and a second position out of contact with adapter 30. Spool valve member 41 is biased to the upward, first position by a biasing spring 50. Valve member 41 is preferably a spool valve member but could instead be another suitable valve member such as a poppet valve member. Spool valve member 41 includes a first hydraulic surface 44 that is exposed to fluid pressure in pressure communication passage 34 via a control chamber 53 and a second hydraulic surface 44 that is exposed to fluid pressure in actuation supply passage 39. First hydraulic surface 44 acts as a control surface such that when it is exposed to high pressure in control chamber 53, for example when electrical actuator 27 is de-energized and pressure communication passage 34 is open to actuation control passage 37, the pressure acting on first hydraulic surface 42 helps move spool valve member 41 toward its upward, biased position.

Spool valve member 41 also defines an internal passage 45 that is in fluid communication with actuation supply passage 39. Internal passage 45 opens through the top of spool valve member 41 and extends past a pair of radial passages 46 that are also defined by spool valve member 41. When spool valve member 41 is in the downward position, radial passages 46 open to a variable pressure passage 43 and allow high pressure actuation fluid to flow into variable pressure passage 43 from actuation supply passage 39 via internal passage 45. Variable pressure passage 43 is in fluid communication with actuation fluid cavity 51. Therefore, when spool valve member 41 is in its downward position, high pressure actuation fluid can flow into actuation fluid cavity 51 from actuation supply passage 39 via variable pressure passage 43, internal passage 45 and radial passages 46. When spool valve member 41 is in the upward, biased position, an annulus 47 that is included on spool valve member 41 is open to a low pressure drain 48 that is fluidly connected to a low pressure reservoir 16. When spool valve member 41 is in this upward position, annulus 47 opens variable pressure passage 43 and actuation fluid cavity 51 to low pressure drain 48.

Returning now to fuel injector 10, a piston 60 is included which can move between an upward position, as shown, and a downward advanced position within injector body 11. Piston 60 is biased toward its upward position by a biasing spring 64. Connected to piston 60 is a plunger 63. As with piston 60, plunger 63 is biased toward its upward position by biasing spring 64. Piston 60 advances due to the hydraulic pressure force exerted on a hydraulic surface 61 which is exposed to fluid pressure in actuation fluid cavity 51. When piston 60 begins to advance, plunger 63 advances in a corresponding fashion and acts as the hydraulic means for pressurizing fuel within a fuel pressurization chamber 67 that is fluidly connected to fuel inlet 19 past a ball check valve 69. Fuel inlet 19 is connected to a source of fuel 81 via a fuel supply passage 82. When plunger 63 is returning to its upward position, fuel is drawn into fuel pressurization chamber 67 past check valve 69. During an injection event as plunger 63 moves toward its downward position, check valve 69 is closed and plunger 63 can act to compress fuel within fuel pressurization chamber 67. Fuel pressurization chamber 67 is fluidly connected to a nozzle outlet 80 via a nozzle supply passage 77.

A direct control needle valve 70 is positioned in injector body 11 and includes a needle valve member 71 that is movable between a first position, in which nozzle outlet 80 is open, and a downward second position in which nozzle outlet 80 is blocked. Needle valve member 71 is mechanically biased toward its downward closed position by a biasing spring 72. Needle valve member 71 includes opening hydraulic surfaces 76 that are exposed to fluid pressure within a nozzle chamber 74 and a closing hydraulic surface 75 that is exposed to fluid pressure within a needle control chamber 73. As illustrated in FIG. 1, needle control chamber 73 is in fluid communication with pressure communication passage 34. Therefore, closing hydraulic surface 75 is exposed to high pressure in control volume 25 when electrical actuator 27 is de-energized and ball valve member 20 is positioned to close low pressure seat 23. Similarly, closing hydraulic surface 75 is exposed to low pressure in control volume 25 when electrical actuator 27 is energized and ball valve member 20 is positioned to close high pressure seat 21.

Closing hydraulic surface 75 and opening hydraulic surfaces 76 are sized such that needle valve member 71 will not move against the action of biasing spring 72 while closing hydraulic surface 75 is exposed to high pressure in pressure communication passage 34. Therefore, even after the pressure of fuel within nozzle chamber 74 has reached an injection pressure, needle valve member 71 will not open nozzle outlet 80 until closing hydraulic surface 75 is exposed to low pressure in pressure communication passage 34. In a similar manner, once electrical actuator 27 is de-energized at the end of an injection event, the high pressure in needle control chamber 73 will act to quickly move needle valve member 71 to close nozzle outlet 80 and abruptly end the injection event. As previously alluded to, the pressure of the actuation fluid acting on closing hydraulic surface 75 is strong enough to overcome the pressure of fuel acting on opening hydraulic surfaces 76 such that needle valve member 71 will not re-open nozzle outlet 80 once electrical actuator 27 is de-energized. It should be appreciated that the relative sizes of closing hydraulic surface 75 and opening hydraulic surfaces 76 and the strength of biasing spring 72 should be such that when closing hydraulic surface 75 is exposed to low pressure in pressure communication passage 34, the high pressure acting on opening hydraulic surfaces 76 should be sufficient to move needle valve member 71 upward against the force of biasing spring 72 to open nozzle outlet 80.

Figure 2:
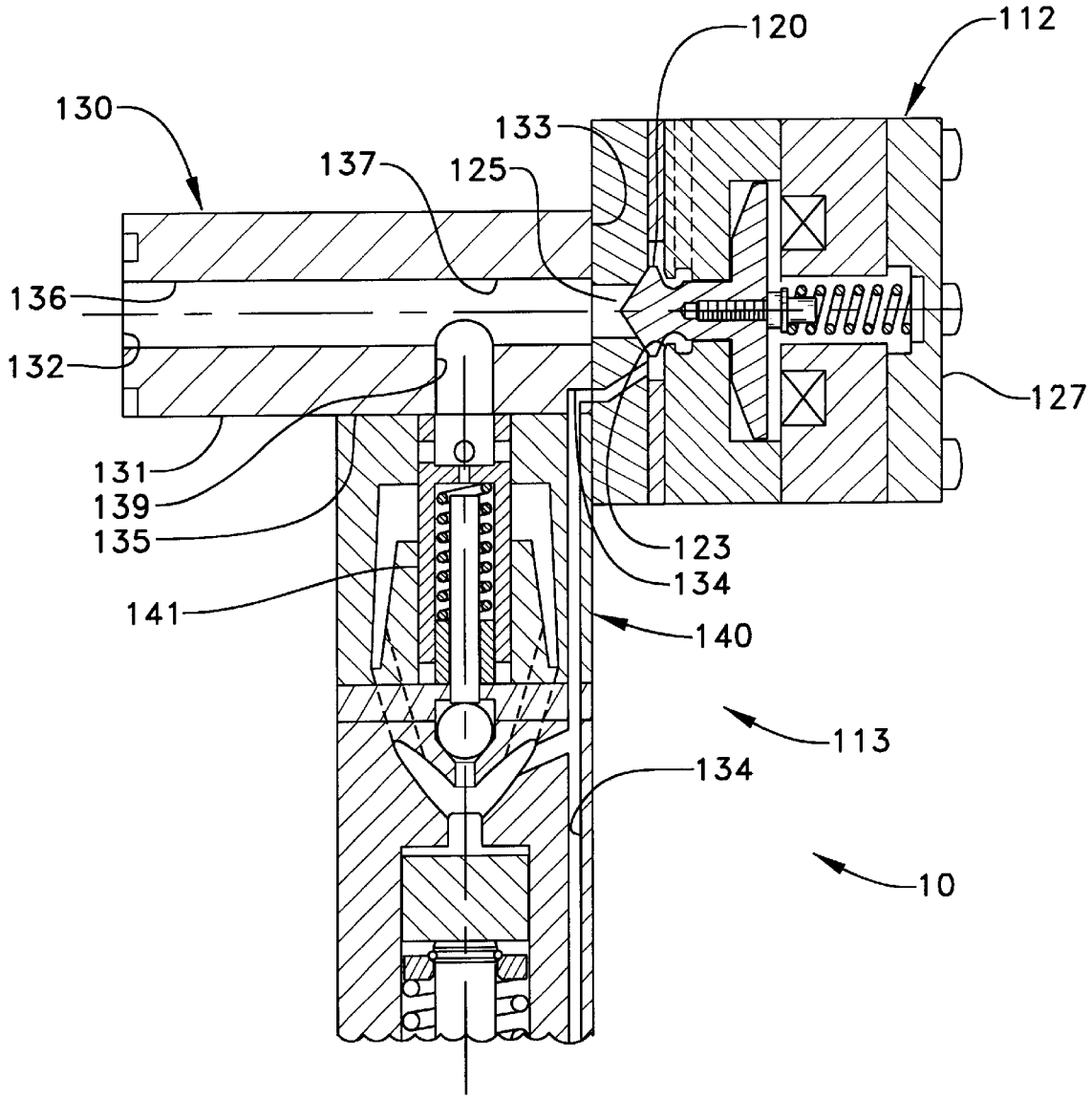
FIG. 2 is a diagrammatic sectioned side view of a fuel injector valve assembly according to another embodiment of the present invention.

Referring now to FIG. 2 there is shown a diagrammatic sectioned side view of fuel injector valve assembly 113 including another embodiment of the present invention. In this embodiment, actuation fluid adapter 130 is intended for use with a side mounted electrical actuator 127. Electrical actuator 127 and pilot valve subassembly 112 are similar to electrical actuator 27 and pilot valve subassembly 12 as disclosed in the FIG. 1 embodiment and therefore, a description of like components will not be included.

Actuation fluid adapter 130 defines an actuation fluid passage that includes three separate branches that open through three separate locations on an outer surface 131. The actuation fluid passage includes an actuation inlet passage 136, an actuation control passage 137 and an actuation supply passage 139. Actuation inlet passage 136 opens through an actuation fluid inlet 132 and is perpendicular to actuation supply passage 139. Actuation fluid flowing through actuation inlet passage 136 flows into actuation control passage 137 or actuation supply passage 139. Actuation supply passage 139 opens through a planar surface 135 that abuts a flow control valve subassembly 140 such that flow control valve subassembly 140 covers actuation supply passage 139. Actuation control passage 137 opens through a planar surface 133 and is covered by pilot valve subassembly 112. Unlike the FIG. 1 embodiment, planar surface 133 is not substantially parallel to planar surface 135.

When electrical actuator 127 is de-energized, high pressure in actuation control passage 137 produces the force that biases pilot valve member 120 to close a low pressure seat 123. A pressure communication passage 134 passes through adapter 130 and opens through planar surfaces 133 and 135. As with the FIG. 1 embodiment, pressure communication passage 134 fluidly connects control volume 125 to various passages in flow control valve subassembly 140 and fuel injector 10. In addition, as with the FIG. 1 embodiment, pressure communication passage 134 is covered by both pilot valve subassembly 112 and flow control valve subassembly 140.

Figure 3:
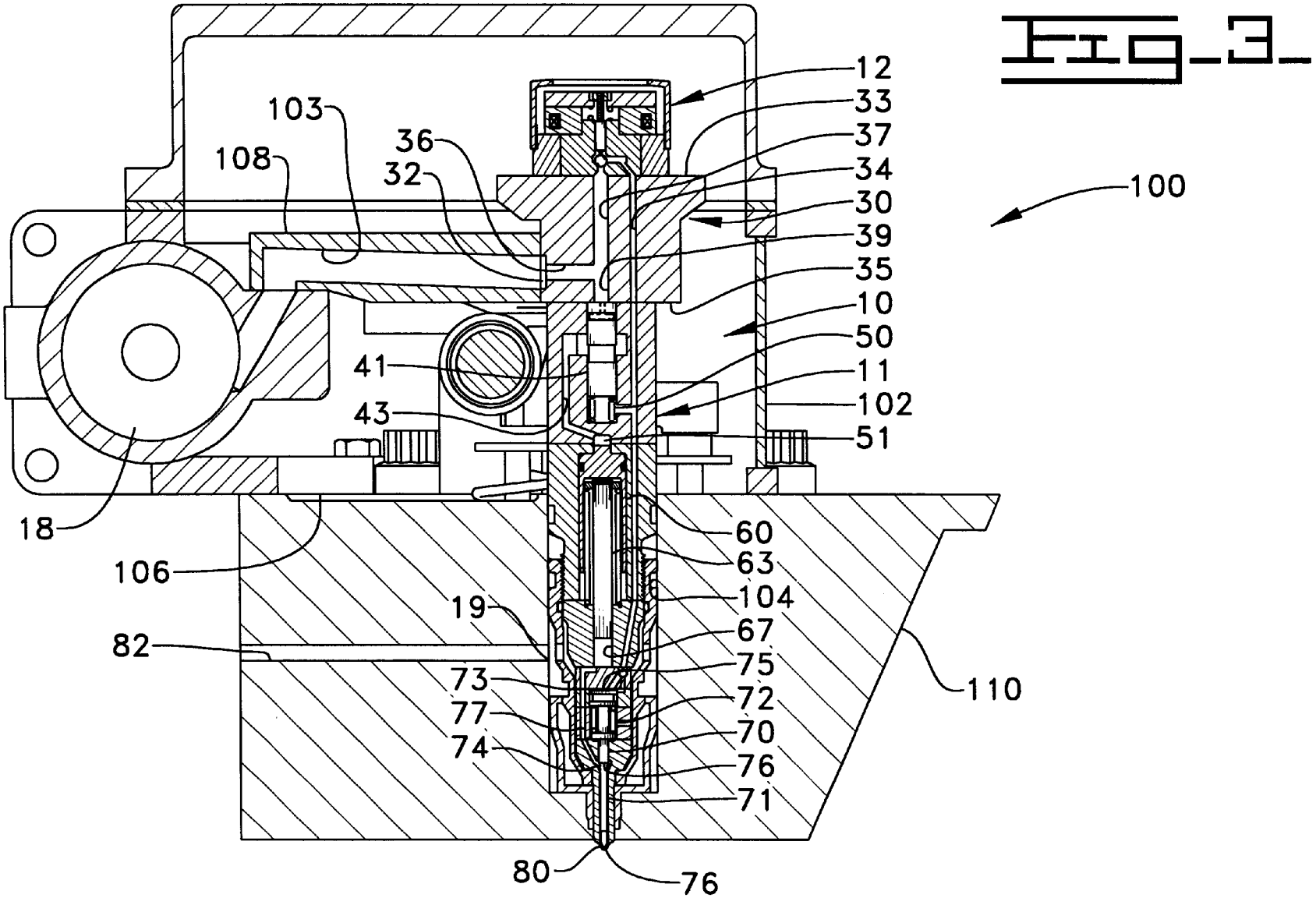
FIG. 3 is a partial diagrammatic sectioned side view of an engine that includes the hydraulically-actuated electronically-controlled fuel injector of FIG. 1.

Referring now to FIG. 3 there is shown a diagrammatic sectioned side view of the fuel injector of FIG. 1 as mounted in an engine 100. Engine 100 includes a cylinder head 102 that is conventionally mounted to a cylinder block 110. Cylinder head 102 includes a conventional fuel supply passage 82 and defines an injector bore 104. Fuel injector 10 is positioned in injector bore 104 and attached to cylinder head 102 via clamp or other suitable means known in the art. As shown in FIG. 3, fuel injector 10 is oriented in injector bore 104 such that nozzle outlet 80 opens adjacent a bottom side 106 of cylinder head 102 and actuation inlet passage 36 opens above a top side 108 of cylinder head 102. A common rail passage 103 is mounted on engine 100 and connects a high pressure manifold 18 to the individual actuation fluid inlets 32 of a plurality of fuel injectors 10 only one of which is shown. Note that, if actuation fluid adapter 30 is not utilized to raise the oil inlet on the fuel injector, engine head 110 would require addition of an interior high pressure manifold in order to accommodate injector 10.

INDUSTRIAL APPLICABILITY

Referring now to FIG. 1, prior to the start of an injection event, low pressure in fuel pressurization chamber 67 prevails and piston 60 and plunger 63 are in their retracted positions, ball valve member 20 is positioned to close low pressure seat 23, spool valve member 41 is in its upward biased position and needle valve member 71 is in its biased position closing nozzle outlet 80. Pressure communication passage 34 is open to high pressure in control volume 25 and actuation control passage 37 such that high pressure actuation fluid is acting on first hydraulic surface 44 of spool valve member 41 and closing hydraulic surface 75 of needle valve member 71. The injection event is initiated by activation of electrical actuator 27, which causes pin 17 to move ball valve member 20 to close high pressure seat 21.

When high pressure seat 21 is closed by ball valve member 20, control volume 25 is exposed to low pressure in low pressure reservoir 16. Pressure communication passage 34 is then open to low pressure vent 14 thus exposing both first hydraulic surface 44 of spool valve member 41 and closing hydraulic surface 75 of needle valve member 71 to low pressure. At the same time, high pressure in actuation supply passage 39 continues to act on second hydraulic surface 42 of spool valve member 41. The combination of low pressure acting on first hydraulic surface 44 and high pressure acting on second hydraulic surface 42 acts to allow spool valve member 41 to advance downward against the action of biasing spring 50 since it is preferably hydraulically balanced. As spool valve member 41 advances, annulus 47 closes variable pressure passage 43 from low pressure drain 48 and radial passages 46 are opened to variable pressure passage 43. Once variable pressure passage 43 is open to radial passages 46, high pressure actuation fluid from actuation supply passage 39 can flow into actuation fluid cavity 51 via internal passage 45 and variable pressure passage 43.

High pressure actuation fluid flowing into actuation fluid cavity 51 acts on hydraulic surface 61 of piston 60 and begins to move piston 60 and plunger 63 downward against the action of biasing spring 64. The downward movement of plunger 63 closes check valve 69 and raises the pressure of the fuel within fuel pressurization chamber 67, nozzle supply passage 77 and nozzle chamber 74. Recall that low pressure is acting on closing hydraulic surface 75 because needle control chamber 73 is fluidly connected to low pressure drain 14 via pressure communication passage 34. The increasing pressure of the fuel within nozzle chamber 74 acts on opening hydraulic surfaces 76 of needle valve member 71. When the pressure exerted on opening hydraulic surfaces 76 exceeds a valve opening pressure, needle valve member 71 is lifted against the action of biasing spring 72, and fuel is allowed to spray into the combustion chamber from nozzle outlet 80.

Shortly before the desired amount of fuel has been injected into the combustion space, electrical actuator 27 is de-energized to end the injection event. Pin 17 is allowed to return to its upward, biased position under the action of biasing spring 15 and ball valve member 20 moves under the high pressure actuation fluid in actuation control passage 37 to close low pressure seat 23. This closes pressure communication passage 34 from fluid communication with low pressure drain 14, and fluidly connects it to actuation control passage 37 via control volume 25. Pressure control passage 34 now delivers high pressure actuation fluid to both control chamber 53 and needle control chamber 73. The high pressure within needle control chamber 101 acts on closing hydraulic surface 75 and causes needle valve member 71 to move to its downward, closed position to close nozzle outlet 80. Also, because high pressure is now acting on first hydraulic surface 44, spool valve member 41 starts moving toward its biased, upward position under the action of biasing spring 50 and the hydraulic pressure acting on first hydraulic surface 44.

As spool valve member 41 moves toward its upward position, but prior to the opening of low pressure drain 48 by annulus 47, piston 60 and plunger 63 stop their downward movement. Also as spool valve member 41 moves upward, annulus 47 opens variable pressure passage 43 to low pressure drain 48. Once variable pressure passage 43 is open to low pressure drain 48, actuation fluid cavity 51 is exposed to low pressure in low pressure drain 48. Because hydraulic surface 61 is now exposed to low pressure in actuation fluid cavity 51, piston 60 and plunger 63 are allowed to move toward their upward, biased positions under the action of biasing spring 64. This upward movement of plunger 63 relieves the pressure on fuel within fuel pressurization chamber 67 and causes a corresponding drop in pressure in nozzle supply passage 77 and nozzle chamber 74.

Between injection events various components of injector body 11 begin to reset themselves in preparation for the next injection event. Because the pressure acting on piston 60 and plunger 63 has dropped, biasing spring 64 moves piston 60 and plunger 63 back to their retracted positions. The retracting movement of plunger 63 causes fuel from fuel inlet 19 to be pulled into fuel pressurization chamber 67 via fuel supply passage 82 past check valve 69.

The present invention moves the oil supply for hydraulically-actuated electronically-controlled fuel injectors to a position above the engine head. This allows these fuel injectors to be retrofitted for use in conventional engines not designed for use with such fuel injectors. Because the adapter of the present invention includes no moving parts, this oil adapter adds no additional components that could fail during operation. Additionally, as illustrated in the specification and drawings, the present invention can be used in fuel injectors having both top and side mounted control valves with little modification. Therefore, the present invention offers a simple, cost-effective solution to incorporating hydraulically-actuated electronically-controlled fuel injectors for use in a wide variety of engines without the need to significantly alter the engine's internal design.

It should be understood that the above description is intended for illustrative purposes only, and is not intended to limit the scope of the present invention in any way. For instance, the present invention can be used to retrofit fuel injectors having both top and side mounted control valves. Further, the valve member could be a poppet valve member instead of a spool valve member, as illustrated. Thus, those skilled in the art will appreciate the various modifications could be made to the disclosed embodiments without departing from the intended scope of the present invention, which is defined in terms of the claims set forth below.

What is claimed is:

1. A fuel injector valve assembly comprising:

a block defining a pressure communication passage therethrough and an actuation fluid passage having three separate branches that open through an outer surface of said block at three separate locations, and said three separate branches include an actuation inlet passage, an actuation supply passage and an actuation control passage;

a pilot valve subassembly attached to said block and covering one end of said pressure communication passage and said actuation control passage; and a flow control valve subassembly attached to said block and covering an other end of said pressure communication passage and said actuation supply passage.

2. The fuel injector valve assembly of claim 1 wherein said block includes a pair of planar surfaces; and said pilot valve assembly abuts one of said planar surfaces, and said flow control valve subassembly abuts an other of said planar surfaces.

3. The fuel injector valve assembly of claim 2 wherein said pair of planar surfaces are substantially parallel.

4. The fuel injector valve assembly of claim 3 wherein said pilot valve assembly includes an electrical actuator; and said flow control valve assembly is operably coupled to said electrical actuator via said pressure communication passage.

5. The fuel injector valve assembly of claim 4 wherein said flow control valve assembly includes a spool valve member that is movable between a first position in contact with said adapter and a second position out of contact with said adapter.

6. An engine comprising:

a head defining an injector bore therethrough;

a hydraulically actuated fuel injector defining a nozzle outlet, and including an adapter, a pilot valve assembly attached to one side of said adapter, and a flow control valve assembly attached to an other side of said adapter, and said adapter defining an actuation inlet passage; and said hydraulically actuated fuel injector being attached to said head and positioned in said injector bore such that said nozzle outlet is exposed adjacent a bottom side of said head and said actuation inlet passage is exposed adjacent a top side of said head.

7. The engine of claim 6 wherein said hydraulically actuated fuel injector defines a fuel inlet positioned within said head.

8. The engine of claim 7 wherein said adapter consists of a block defining a pressure communication passage therethrough and an actuation fluid passage having three separate branches that open through an outer surface of said block at three separate locations, and said three separate branches include said actuation inlet passage, an actuation supply passage and an actuation control passage.

9. The engine of claim 8 wherein said pilot valve assembly covers one end of said pressure communication passage and said actuation control passage; and said flow control valve assembly covers an other end of said pressure communication passage and said actuation supply passage.

10. The engine of claim 9 wherein said block includes a pair of planar surfaces; and said pilot valve assembly abuts one of said planar surfaces, and said flow control valve subassembly abuts an other of said planar surfaces.

11. The engine of claim 10 wherein said pair of planar surfaces are substantially parallel.

12. The engine of claim 10 wherein said pilot valve assembly includes an electrical actuator; and said flow control valve assembly is operably coupled to said electrical actuator via said pressure communication passage.

13. The engine of claim 12 wherein said flow control valve assembly includes a spool valve member with a first hydraulic surface exposed to fluid pressure in said pressure communication passage, and a second hydraulic surface exposed to fluid pressure in said actuation supply passage.

14. The engine of claim 13 wherein said spool valve member is movable between a first position in contact with said adapter and a second position out of contact with said adapter.

15. The engine of claim 14 wherein said hydraulically actuated fuel injector includes a direct control needle valve member with a closing hydraulic surface exposed to fluid pressure in said pressure communication passage.

* * * * *